US007298990B2

(12) United States Patent
Nishimura

(10) Patent No.: US 7,298,990 B2
(45) Date of Patent: Nov. 20, 2007

(54) PROCESS CARTRIDGE AND IMAGE FORMING APPARATUS

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 177 days.

(21) Appl. No.: 11/061,876

(22) Filed: Feb. 22, 2005

(65) Prior Publication Data

US 2005/0191090 A1 Sep. 1, 2005

(30) Foreign Application Priority Data

Feb. 27, 2004 (JP) ..... 2004-053105

(51) Int. Cl.
*G03G 21/18* (2006.01)

(52) U.S. Cl. ..... 399/113; 399/111; 399/119

(58) Field of Classification Search ..... 399/110–114, 399/119

See application file for complete search history.

(56) References Cited

U.S. PATENT DOCUMENTS 6,075,957 A * 6/2000 Batori et al. ..... 399/114
6,647,227 B2 11/2003 Yokoi et al.
6,751,428 B2 6/2004 Okabe

FOREIGN PATENT DOCUMENTS

JP A 2003-084645 3/2003
JP A 2003-107975 4/2003

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

A developing cartridge includes an engagement device that is capable of being engaged with an engaging member associated with a frame, wherein: the engagement device can be placed in a restricting state where the engagement device is engaged with the engaging member, the engagement device can be placed in an unrestricting state where the engagement device is disengaged from the engaging member, and the engagement device is automatically placed in the unrestricting state when the developing cartridge is placed in an image forming device.

22 Claims, 10 Drawing Sheets

PROCESS CARTRIDGE AND IMAGE FORMING APPARATUS

INCORPORATION BY REFERENCE

This application claims priority from JP 2004-053105, filed Feb. 27, 2004, the subject matter of which is incorporated herein in its entirety by reference thereto.

BACKGROUND

The disclosure relates to a process cartridge and an image forming apparatus equipped with the process cartridge.

Conventionally, a process cartridge is loaded into an image forming apparatus, such as a laser printer. The process cartridge includes a photosensitive drum on which an electrostatic latent image is formed and a developing cartridge that develops the electrostatic latent image formed on the photosensitive drum into a toner image.

The developing cartridge is mounted to a drum cartridge supporting the photosensitive drum. The developing cartridge includes a developing roller that supplies toner onto a surface of the photosensitive drum. As the developing roller rotates in a state where the developing cartridge is mounted to the drum cartridge and the developing roller faces the photosensitive drum, toner is supplied to the surface of the photosensitive drum from the developing roller. An electrostatic latent image is thus developed into a toner image. The developed toner image is then transferred onto a sheet, which is fed between the photosensitive drum and the transfer roller, by the transfer roller disposed opposite the photosensitive drum.

For example, U.S. Pat. No. 6,751,428 discloses such a process cartridge including a locking device for maintaining a state where the developing cartridge is attached to the drum cartridge. In the process cartridge, the drum cartridge includes a shaft that extends along an upstream end face in a developing cartridge attaching direction, and a locking lever that is rotatably supported by the shaft. The developing cartridge includes a locking protrusion that protrudes therefrom toward the upstream side in the developing cartridge mounting direction. The locking lever is rotated about the shaft to engage the locking protrusion in order to prevent the developing cartridge from becoming detached from the drum cartridge. By doing so, the attachment of the developing cartridge to the drum cartridge is maintained.

SUMMARY

However, the locking lever is manually switched between a locked state where the locking lever is engaged with the locking protrusion and an unlocked state where the locking lever is disengaged from the locking protrusion. Therefore, to remove the developing cartridge from the image forming apparatus in the state where the process cartridge is mounted to the image forming apparatus, the locking lever needs to be manually disengaged from the locking protrusion and then the developing cartridge is pulled out of the image forming apparatus.

The disclosure thus provides, among other things, a process cartridge that achieves an improvement in operability when a developing cartridge is detached from an image forming apparatus and an image forming apparatus including the process cartridge.

An exemplary developing cartridge includes an engagement device that is capable of being engaged with an engaging member associated with a frame, wherein: the engagement device can be placed in a restricting state where the engagement device is engaged with the engaging member, the engagement device can be placed in an unrestricting state where the engagement device is disengaged from the engaging member, and the engagement device is automatically placed in the unrestricting state when the developing cartridge is placed in an image forming device.

An exemplary process cartridge includes a frame; and an engaging member that is provided to the frame, wherein: the engaging member includes an engagement portion and a disengagement portion, the disengagement portion automatically moves the engaging member to a first position when the process cartridge is placed in an image forming device, and the engagement portion automatically moves the engaging member to a second position when the process cartridge is removed from the image forming device.

BRIEF DESCRIPTION OF THE DRAWINGS

Exemplary embodiments of the disclosure will be described in detail with reference to the following figures wherein.

DETAILED DESCRIPTION OF EMBODIMENTS

Figure 1:
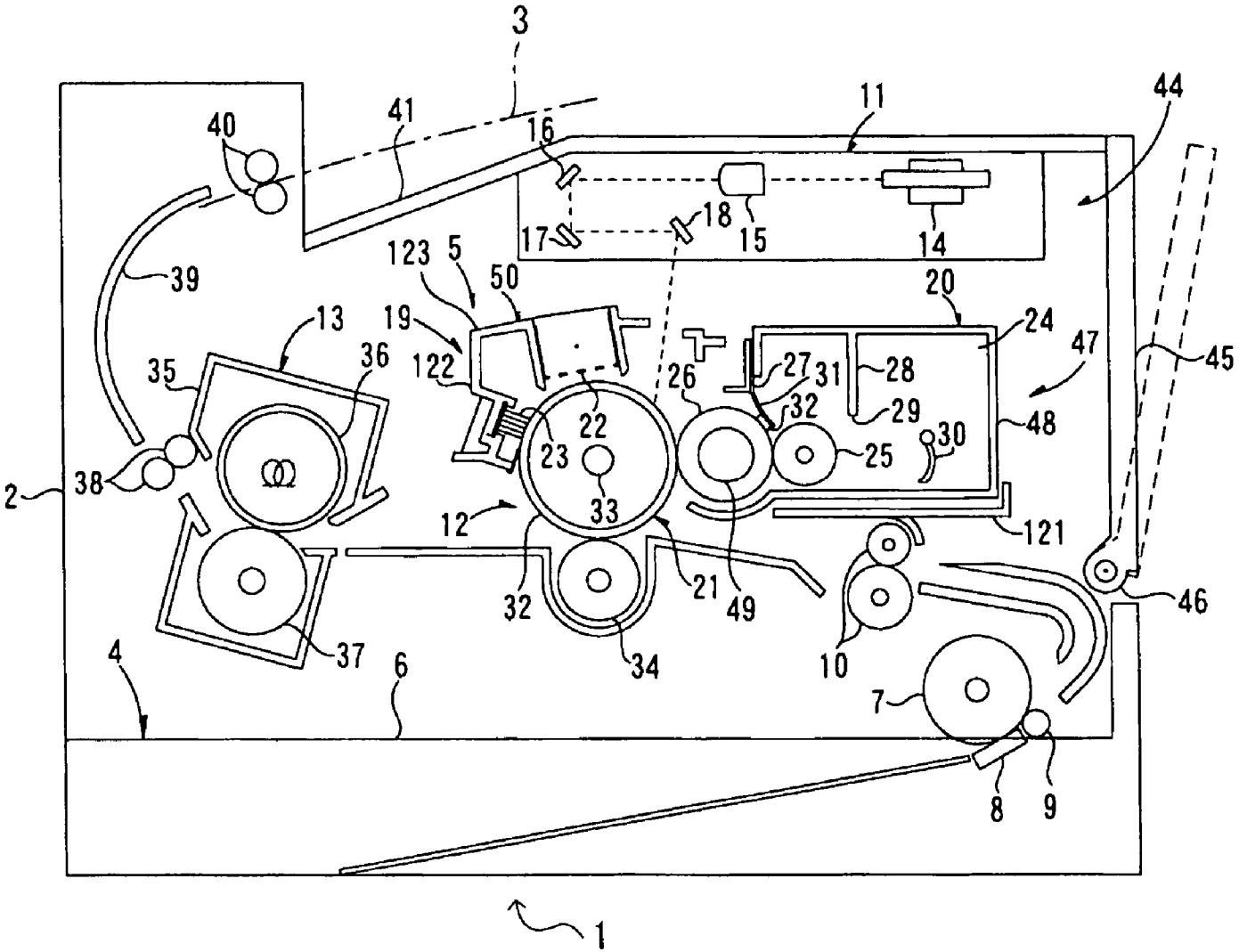
FIG. 1 is a side sectional view showing essential parts of a laser beam printer, as an image forming apparatus, of an exemplary embodiment of the disclosure.

Exemplary embodiments of the disclosure will be described with reference to the accompanying drawings. As shown in FIG. 1, a laser beam printer 1 as an image forming apparatus includes a body casing 2, a sheet feeding portion 4 that feeds a sheet 3 as a recording medium, and an image forming portion 5 that forms an image onto the fed sheet 3. The sheet feeding portion 4 and the image forming portion 5 are provided in the body casing 2.

The body casing 2 has an opening 44, through which a process cartridge 19 (described later) is mounted to the laser beam printer 1, at its one side wall. For opening and closing the opening 44, a front cover 45 as a cover member is provided to the one side wall of the body casing 2. The front cover 45 is rotatably attached to the body casing 2 via a hinge 46 at its lower end. When the front cover 45 is closed by rotating about the hinge 46, the opening 44 is closed. When the front cover 45 is opened by rotating about the hinge 46, the opening 44 is open, so that the process cartridge 19 can be mounted to the laser beam printer 1 therethrough.

In the body casing 2, a mounting path 47 is provided extending substantially in parallel with a sheet conveying direction so as to communicate with the opening 44. The process cartridge 19 is mounted to and removed from the body casing 2 through the mounting path 47.

Hereinafter, in the laser beam printer 1 and the process cartridge 19, a side on which the front cover 45 is provided is defined as the front and an opposite side on which a fixing portion 13 (described later) is provided is defined as the rear, in a state where the process cartridge 19 is attached to the body casing 2, throughout the description.

The sheet feeding portion 4 is provided at the bottom of the body casing 2 and includes a sheet feeding tray 6, which can hold a stack of sheets 3 therein, a sheet supply roller 7 and a sheet supply pad 8, which are disposed above a front end of the sheet feeding tray 6, a paper dust removing roller 9, which is provided downstream of the sheet supply pad 8 in the sheet conveying direction, and a pair of resist rollers 10, which is provided downstream of the paper dust removing roller 9 in the sheet conveying direction.

The sheet supply roller 7 and the sheet supply pad 8 are disposed so as to be opposite each other. The sheet supply pad 8 is pressed against the sheet supply roller 7 by a spring (not shown) provided below the sheet supply pad 8.

A topmost sheet 3 in the stack placed in the sheet feeding tray 6 is pressed against the sheet supply roller 7. The topmost sheet 3 is then pinched by the sheet supply roller 7 and the sheet supply pad 8 and is separated and supplied from the stack, one by one, by a rotation of the sheet supply roller 7. The fed sheet 3 then passes the paper dust removing roller 9, so that paper dust adhering to the sheet 3 is removed therefrom. After that, the sheet 3 is further conveyed to the resist rollers 10. The resist rollers 10 resist the conveyance of the sheet 3 and then further feed the sheet 3 to an image transfer position (which is provided between a photosensitive drum 21 (described later) and a transfer roller 34 (described later) and at which a toner image formed on the photosensitive drum 21 is transferred onto the sheet 3) in an image forming portion 5.

The image forming portion 5 includes a scanning portion 11, a process portion 12, and the fixing portion 13.

The scanning portion 11 provided at the upper portion of the body casing 2, includes a laser emitting portion (not shown), a rotatable polygon mirror 14, a lens 15 and three reflectors 16, 17, 18. In the scanning portion 11, a laser beam, which is emitted from the laser emitting portion based on image data, passes or is reflected off the polygon mirror 14, the lens 15, the reflector 16, the reflector 17 and the reflector 18 in this order, and is finally applied to a surface of the photosensitive drum 21 of the process cartridge 19 by high-speed scanning, as indicated by a dashed line.

The process portion 12 includes the process cartridge 19 mounted to the body casing 2 and the transfer roller 34 as a transfer device provided to the body casing 2.

The process cartridge 19 is attached to the body casing 2, below the scanning portion 11. The process cartridge 19 includes a frame 50, the developing cartridge 20 to be accommodated in the frame 50, the photosensitive drum 21 as an image holding body, a scorotron charging device 22, and a cleaning brush 23.

As shown in FIG. 2, the frame 50 includes a pair of side plates 51 provided opposite to each other at a predetermined distance from each other, a front plate 91 connecting the side plates 51 at their front edges, a bottom plate 121 connecting the side plates 51 at their lower edges, a rear plate 122 (FIG. 1) connecting the side plates 51 at their rear edges, and a top plate 123 connecting the side plates 51 at their upper edges.

Each of the side plates 51 includes a rear side-plate-portion 52 having a substantially rectangular shape and a front side-plate-portion 53 having an elongated plate shape, which are integrated with each other. The front side-plate-portion 53 extends forward from a lower end portion of a front edge of the rear side-plate-portion 52.

The front plate 91 connects the side plates 51 at the front edges of the front side-plate-portions 53. The front plate 91 includes a drum handle 56, as a frame-side operating portion, having a horizontal portion 54 and a pendent portion 55. The horizontal portion 54 extends forward from the front plate 91. The pendent portion 55 extends downward from a front end of the horizontal portion 54.

Each of the rear side-plate-portions 52 has a semi-circular engaging portion 57 at its front edge. The engaging portion 57 can be engaged with a roller shaft 49 (described later) of the developing roller 26. In each rear side-plate-portion 52, a lower edge of the engaging portion 57 continuously extends to an upper edge of the front side-plate-portion 53.

The bottom plate 121 connects the front side-plate-portions 53 of the side plates 51 at their lower edges. The bottom plate 121 is provided from the front edges to the midway portions of the front side-plate-portions 53.

The rear plate 122 connects the rear side-plate-portions 52 of the side plates 51 at their rear edges. The top plate 123 connects the rear side-plate-portions 52 of the side plates 51 at their upper edges.

In the frame 50, the developing cartridge 20 is mounted to a cartridge mount portion 124 defined by the side plates 51, the bottom plate 121 and the front plate 91. As shown in FIG. 1, the developing cartridge 20 includes a housing 48, a toner storage chamber 24, a toner supply roller 25, the developing roller 26 and a layer thickness regulating blade 27. The toner storage chamber 24, the toner supply roller 25, the developing roller 26 and the layer thickness regulating blade 27 are accommodated in the housing 48.

Figure 2B:
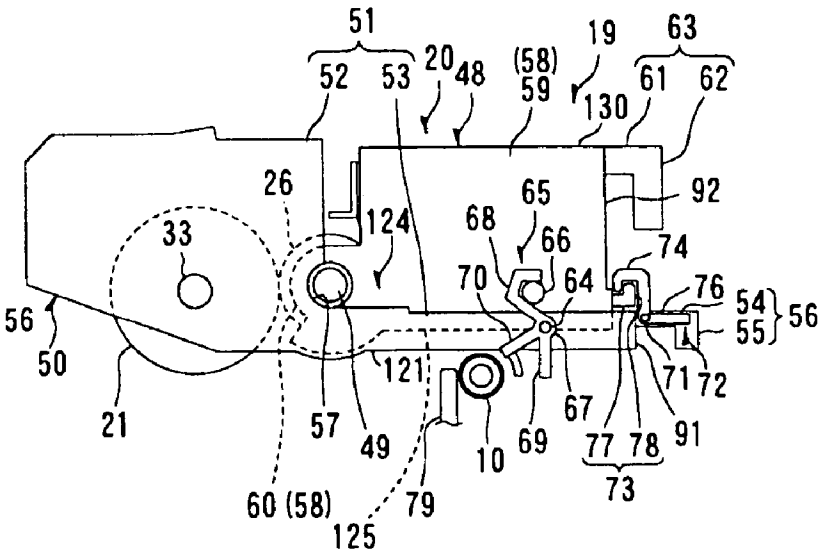
FIG. 2B is a side view of the process cartridge of FIG. 2A, wherein the process cartridge is separated from the body casing.
Figure 2A:
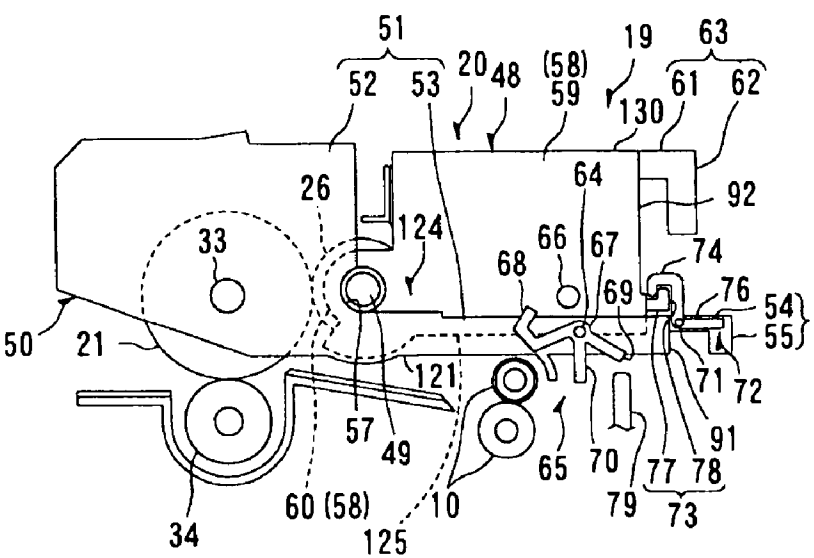
FIG. 2A is a side view of a process cartridge for the laser printer of FIG. 1, wherein the process cartridge is attached to a body casing.

As shown in FIGS. 2A and 2B, the housing 48 includes side walls 58 provided on opposite sides of the toner storage chamber 24, a front wall 92 connecting the side walls 58 at their front edges, a bottom wall 125 connecting the side walls 58 at their lower edges, and a top wall 130 connecting the sides walls 58 at their upper edges. The side walls 58, the front wall 92, the bottom wall 125 and the top wall 130 are integrated with each other. With this structure, the housing 48 has a box shape with a rear open structure.

Each of the side walls 58 includes a front side-wall-portion 59 having a substantially rectangular shape and a projecting portion 60 projecting rearward from a lower end portion of a rear edge of the front side-wall-portion 59, when viewed from the side.

The front wall 92 connects the side walls 58 at front edges of the front side-wall-portions 59. The front wall 92 includes a developing cartridge handle 63, as a developing-cartridge-side operating portion, having a horizontal portion 61 and a pendent portion 62. The horizontal portion 61 extends forward from an upper end of the front wall 92. The pendent portion 62 extends downward from a front end of the horizontal portion 61.

The bottom wall 125 connects the side walls 58 at lower edges of the front side-wall-portions 59. The top wall 130 connects the side walls 58 at upper edges of the front side-wall-portions 59.

As shown in FIG. 1, the toner storage chamber 24 is achieved by an internal space provided at the front part of the developing cartridge 20 divided by a partition 28. A toner discharge opening 29 is provided under the partition 28 so as to communicate the divided spaces with each other in the front and rear direction. The toner storage chamber 24 stores positively charged non-magnetic single-component toner, as developing agent. The toner is a polymerized toner obtained through co-polymerization of styrene-based monomers, such as styrene, and acryl-based monomers, such as acrylic acid, alkyl(C1-C4)acrylate, alkyl (C1-C4)methacrylate, using a known polymerization method, such as suspension polymerization. The polymerized toner has a substantially spherical shape and has excellent fluidity. Thus, a high quality image can be formed.

A coloring agent, such as carbon black, and wax are added to the polymerized toner. An external additive, such as silica, is also added to the polymerized toner to improve its fluidity. The particle size of the polymerized toner is approximately 6-10 μm.

An agitator 30 is provided in the toner storage chamber 24. The toner stored in the toner storage chamber 24 is agitated by the agitator 30.

The toner supply roller 25 is rotatably supported by the developing cartridge 20, next to and behind the toner discharge opening 29. The toner supply roller 25 includes a metal roller shaft covered with a roller portion made of a conductive foam material. The toner supply roller 25 is driven and rotated by the power from the motor (not shown).

The developing roller 26 is disposed behind the toner supply roller 25. The developing roller 26 is rotatably supported between the projecting portions 60 of the side walls 58 of the housing 48 while being in contact with the toner supply roller 25 so that they are press-deformed against each other to an appropriate extent. Therefore, the developing roller 26 is partially exposed to the outside from the rear of the housing 48. The developing roller 26 includes the metal roller shaft 49 covered with a roller portion made of a conductive rubber material. More specifically, the roller portion of the developing roller 26 is made of a conductive urethane or silicone rubber containing carbon particles and its surface is covered with a coating layer made of a urethane or silicone rubber containing fluorine. A predetermined developing bias is applied to the developing roller 26 at the time of development. The developing roller 26 is driven and rotated in the same direction as the rotation of the toner supply roller 25 by the power from the motor (not shown).

As shown in FIGS. 2A and 2B, both end portions of the roller shaft 49 outwardly protrude from the respective projecting portions 60 of the side walls 58 in a width direction (in a direction in which the side walls 58 are opposite to each other).

The layer thickness regulating blade 27 includes a blade body 31 made of a metal leaf spring and a pressing portion 32 made of an insulative silicone rubber. The pressing portion 32 having a semi-circular shape in cross section is provided at a free end of the blade body 31. The layer thickness regulating blade 27 is situated near the developing roller 26. The pressing portion 32 provided at the free end of the blade body 31 presses the developing roller 26 by an elastic force of the blade body 31.

The developing cartridge 20 is attached to the cartridge mount portion 124 of the frame 50 such that both end portions, outwardly protruding from the projecting portions 60 in the width direction, of the roller shaft 49 of the developing roller 26 are engaged with the respective engaging portions 57 of the rear side-plate-portions 52 of the side plates 51. When the developing cartridge 20 is attached to the cartridge mount portion 124 of the frame 50, the partially exposed portion of the developing roller 26 opposingly contacts the photosensitive drum 21.

In the toner storage chamber 24, the toner agitated by the agitator 30 is discharged toward the toner supply roller 25 through the toner discharge opening 29 provided under the partition 28.

The toner discharged from the toner discharge opening 29 is then supplied to the developing roller 26 by the rotation of the toner supply roller 25. At that time, the toner is positively charged by friction caused between the toner supply roller 25 and the developing roller 26. The toner supplied onto the developing roller 26 is further supplied between the pressing portion 32 of the layer thickness regulating blade 27 and the developing roller 26 by the rotation of the developing roller 26, so that the toner becomes a thin layer having a uniform thickness and is held on the developing roller 26.

The photosensitive drum 21 is disposed behind the developing cartridge 20 so as to be opposite the developing roller 26. The photosensitive drum 21 has a cylindrical body and a drum shaft 33 provided at the center of an axis of the photosensitive drum 21. The photosensitive drum 21 is rotatably supported between the rear side-plate-portions 52 of the side plates 51 of the frame 50, via the drum shaft 33. The surface of the conductive cylindrical body, made of, for example, aluminum, of the photosensitive drum 21 is covered with a positively-charged photosensitive layer. The cylindrical body of the photosensitive drum 21 is connected to a ground.

As shown in FIGS. 2A and 2B, the drum shaft 33 is provided such that its end portions outwardly protrude from the respective side plates 51 in the width direction.

The scorotron charging device 22 is located above the photosensitive drum 21, at a predetermined distance, so as not to contact the photosensitive drum 21, while being supported by the top plate 123. The scorotron charging device 22 is a charging device that generates corona discharge from charging wires, such as tungsten wires, in order to uniformly positively charge the surface of the photosensitive drum 21.

The cleaning brush 23 is supported by the rear plate 122, behind the photosensitive drum 21, so as to be opposite to the photosensitive drum 21 and be in contact with the surface of the photosensitive drum 21.

The process cartridge 19 having the developing cartridge 20 is attached to the body casing 2 through the mounting path 47 from the opening 44 by opening the front cover 45.

The transfer roller 34 is provided in the body casing 2. In the state where the process cartridge 19 is attached to the body casing 2, the transfer roller 34 is in contact with the photosensitive drum 21 so as to be opposite to each other in the up and down direction and forms (provides) a nip portion therebetween. Because the transfer roller 34 is provided in the body casing 2, the process cartridge 19 can be downsized. The transfer roller 34 includes a metal roller shaft covered with a roller portion made of a conductive rubber material.

A predetermined transfer bias is applied to the transfer roller 34 at the time of transfer. The transfer roller 34 is driven and rotated by the power from a motor (not shown). The surface of the photosensitive drum 21 is uniformly positively charged by the scorotron charging device 22 in accordance with the rotation of the photosensitive drum 21. Then, the surface of the photosensitive drum 21 is exposed to a laser beam emitted from the scanning portion 11 by a high-speed scanning and an electrostatic latent image, which corresponds to an image to be transferred onto the sheet 3, is formed onto the surface of the photosensitive drum 21.

After that, when the electrostatic latent image on the photosensitive drum 21 faces and contacts the developing roller 26, the positively charged toner held on the developing roller 26 is supplied onto and held by the electrostatic latent image formed on the photosensitive drum 21, i.e., a portion whose potential is lowered by the exposure by the laser beam. Thus, the latent image formed on the photosensitive drum 21 is visualized, and thus, an toner image is formed on the surface of the photosensitive drum 21 by a reversal phenomenon.

Then, the toner image held by the surface of the photosensitive drum 21 is transferred onto the sheet 3 while the sheet 3 passes between the photosensitive drum 21 and the transfer roller 34 (the transfer position), by a transfer bias applied to the transfer roller 34. The sheet 3 onto which the toner image is transferred is then conveyed to the fixing portion 13.

The residual toner remaining on the photosensitive drum 21 after the transfer is collected by the developing roller 26. The paper dust adhered to the photosensitive drum 21 from the sheet 3 after the transfer is collected by the cleaning brush 23.

The fixing portion 13 is provided behind the process cartridge 19 and includes a fixing frame 35, a heat roller 36, a pressing roller 37 and a pair of conveyor rollers 38. The heat roller 36, the pressing roller 37 and the pair of conveyor rollers 38 are provided in the fixing frame 35.

The heat roller 36 includes a metal base tube and a halogen lamp in the base tube to generate heat. The heat roller 36 is driven and rotated by the power from the motor (not shown).

The pressing roller 37 is opposingly disposed below the heat roller 36 so as to press the heat roller 36. The pressing roller 37 includes a metal roller shaft covered with a roller portion made of rubber material. The pressing roller 37 rotates by following the rotation of the heat roller 36.

The pair of conveyor rollers 38 is disposed behind the heat roller 36 and the pressing roller 37, that is, downstream of the heat roller 36 and the pressing roller 37 in the sheet conveying direction.

At the fixing portion 13, the toner transferred onto the sheet 3 at the transfer position is thermally fixed onto the sheet 3 while the sheet 3 passes between the heat roller 36 and the pressing roller 37. The sheet 3 on which the toner is fixed is further conveyed to a sheet discharge path 39 extending toward the top of the body casing 2. The sheet 3 conveyed to the sheet discharge path 39 is then discharged onto a sheet discharge tray 41 provided at the top of the body casing 2 by a pair of sheet discharge rollers 40, which is provided above the discharge path 39.

In the laser beam printer 1, as shown in FIG. 2A, the process cartridge 19 includes a support shaft 64, an engaging member 65, and an engagement boss 66 as an engaged portion, on each side. The support shafts 64, the engaging members 65, and the engagement bosses 66 function as an engagement device. Although explanations will be given for each one of the support shafts 64, the engaging members 65 and the engagement bosses 66 only, they have the same structure and function on each side.

The support shaft 64 is provided to the front side-plate-portion 53 of the side plate 51 of the frame 50. More specifically, the support shaft 64 outwardly protrudes in the width direction from a forward portion of the front side-plate-portion 53 in the front and rear direction.

The engaging member 65 is rotatably supported by the support shaft 64. The engaging member 65 includes a shaft insertion portion 67, into which the support shaft 64 is inserted, an engaging portion 68, which is connected with the shaft insertion portion 67 at its one end and has a substantially C-shape, a disengagement operating portion 69 as a release member and an engagement operating portion 70 as a retuning member, both of which linearly extend in predetermined respective directions from the shaft insertion portion 67. The shaft insertion portion 67, the engaging portion 68, the disengagement operating portion 69 and the engagement operating portion 70 are integrated with each other. The engaging member 65 can rotate about the support shaft 64 within a range of predetermined angles, between an unrestricting position where the engaging portion 68 faces the support shaft 64 substantially in the horizontal direction (FIG. 2A) and a restricting position where the engaging portion 68 faces the support shaft 64 in the up and down direction (FIG. 2B).

In the engaging member 65, the disengagement operating portion 69 and the engagement operating portion 70 are provided so as to form a substantially V-shape having an angle that the engaging member 65 can rotate (the above-described predetermined angle). The disengagement operating portion 69 extends in the up and down direction substantially perpendicular to the axial direction of the support shaft 64 and downwardly protrudes from the front side-plate-portion 53, in a state where the engaging portion 68 is located at the restricting position (FIG. 2B). The engagement operating portion 70 extends in the up and down direction substantially perpendicular to the axial direction of the support shaft 64 and downwardly protrudes from the front side-plate-portion 53, in a state where the engaging portion 68 is located at the unrestricting position (FIG. 2A). When the disengagement operating portion 69 downwardly protrudes from the front side-plate-portion 53, the engagement operating portion 70 downwardly extends at an incline toward the rear (FIG. 2B). When the engagement operating portion 70 downwardly protrudes from the front side-plate-portion 53, the disengagement operating portion 70 downwardly extends at an incline toward the front (FIG. 2A).

The engagement boss 66 protrudes from the side wall 58 of the housing 48 of the developing cartridge 20, so as to extend substantially in parallel with the support shaft 64 toward the restricting position, in the state where the developing cartridge 20 is attached to the frame 50. The engagement boss 66 has a cylindrical shape and has a diameter so that the engaging portion 68 can engage a periphery of the engagement boss 66. With this structure, when the engaging member 65 rotates to move the engaging portion 68 to the restricting position in the state where the developing cartridge 20 is attached to the frame 50, the engaging portion 68 is engaged with the engagement boss 66 to establish a restricted state where the detachment of the developing cartridge 20 from the frame 50 is restricted. When the engaging member 65 rotates in the reverse direction to move the engaging portion 68 to the unrestricting position, the engaging portion 68 is disengaged from the engagement boss 66 to establish an unrestricted state where the detachment of the developing cartridge 20 from the frame 50 is permitted.

The process cartridge 19 further includes a support shaft 71 as a second support shaft, a manual engaging member 72 as a second engaging member, and an engagement member 73 as a second engaged member. The support shaft 71, the manual engaging member 72 and the engagement member 73 function as a manual engagement device.

The support shaft 71 is provided to extend from the outer surface of the horizontal portion 54 of the drum handle 56, in the width direction substantially in parallel to the front plate 91 of the frame 50.

The manual engaging member 72 includes a hook portion 74 and a manual operating portion 76, which are integrated with each other. The hook portion 74 has a substantially C-shape at its free end when viewed from the side. The manual operating portion 76 extends in a direction substantially perpendicular to the hook portion 74. The support shaft 71 is inserted into a joint portion of the hook portion 74 and the manual operating portion 76. Thus, the manual engaging member 72 is supported by the support shaft 71 so as to be rotatable between a restricting position and an unrestricting position by manually operating the manual operating portion 76 to rotate the manual engaging member 72 about the support shaft 71. When the manual engaging member 72 is located at the restricting position, the manual operating portion 76 extends substantially in the horizontal direction along the horizontal portion 54 of the drum handle 56. When the manual engaging member 72 is located at the unrestricting position, the manual operating portion 76 extends in the up and down direction along the pendent portion 55 of the drum handle 56.

The engagement member 73 includes a horizontal portion 77, which extends forward from the front wall 92 of the housing 48, and a projecting portion 78, which is upwardly bent from a front end of the horizontal portion 77, in the state where the developing cartridge 20 is attached to the frame 50. The horizontal portion 77 and the projecting portion 78 are integrated with each other.

Figure 3:
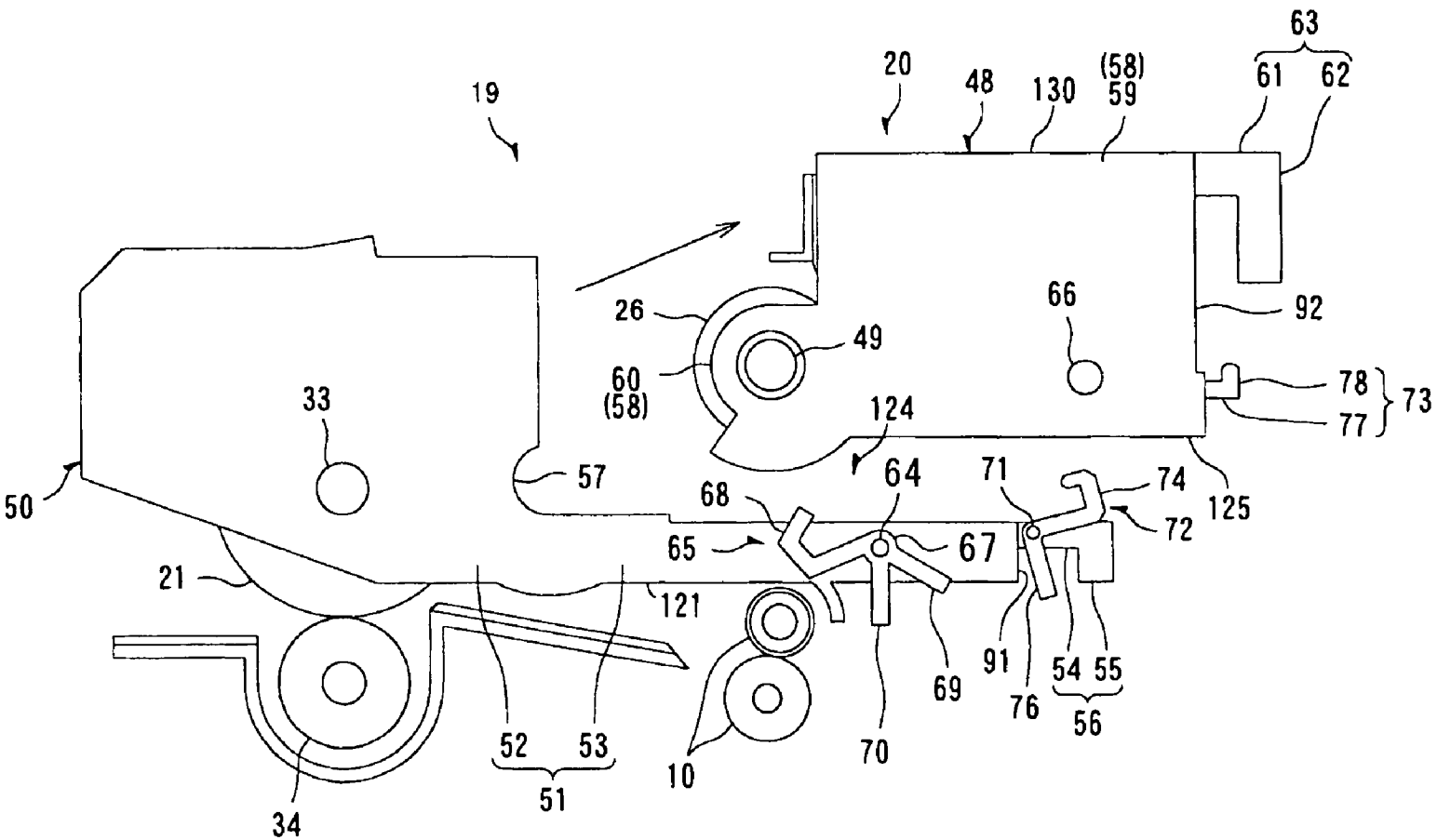
FIG. 3 is a side view of the process cartridge of FIG. 2A with a developing cartridge removed therefrom.

The projecting portion 78 is designed so as to enter a space of the substantially C-shaped free end portion of the hook portion 74 of the manual engaging member 72 when the manual engaging member 72 is located at the restricting position. With this structure, when the manual engaging member 72 is rotated to the restricting position in the state where the developing cartridge 20 is attached to the frame 50, the hook portion 74 is engaged with the projecting portion 78, so that the restricted state where the detachment of the developing cartridge 20 from the frame 50 is restricted is established. When the manual engaging member 72 is rotated to the unrestricting position from the restricting position, the hook portion 74 is disengaged from the projecting portion 78, so that the unrestricted state where the detachment of the developing cartridge 20 from detached from the frame 50 is permitted is established, as shown in FIG. 3.

As shown in FIGS. 2A and 2B, in the body casing 2, a pillar member 79, as a first contact portion, is provided on each side so as to extend from below and toward the mounting path 47. The pillar member 79 is disposed such that its tip portion is located in a path through which the disengagement operating portion 69 and the engagement operating portion 70 of the engaging member 65 passes during the attachment and detachment of the process cartridge 19. More specifically, when the engaging member 65 is located at the restricting position, the disengagement operating portion 69 faces the tip portion of the pillar member 79 substantially in the horizontal direction and the engagement operating portions 70 are positioned above the pillar members 79 without facing the pillar members 79. When the engaging member 65 is located at the unrestricting position, the engagement operating portion 70 faces the pillar member 79 and the disengagement operating portion 69 is positioned above the pillar member 79 without facing the pillar member 79.

The restricted state of the process cartridge 19 is established at the engaging members 65 and the manual engaging member 72 by which the engaging portion 68 of the engaging member 65 is engaged with the engagement boss 66 and the hook portion 74 of the manual engaging member 72 is engaged with the projecting portion 78 while the developing cartridge 20 is attached to the frame 50. Thus, the detachment of the developing cartridge 20 from the frame 50 is restricted (FIG. 2B). To attach the process cartridge 19 in the restricted state to the body casing 2, as described above, first, the front cover 45 is opened to open the opening 44. After that, the process cartridge 19 is inserted into the body casing 2 through the opening 44 and is moved rearward along the mounting path 47 by operating the drum handle 56 from the front. Then, the disengagement operation member 69 contacts the pillar member 79 after the engagement operating portion 70 passes above the pillar member 79. In accordance with the movement of the process cartridge 19, the lower end portion of the disengagement operating portion 69 is pushed upward by the pillar member 79, so that the engaging member 65 rotates about the support shaft 64 to disengage the engaging portion 68 of the engaging member 56 from the engagement boss 66. Accordingly, the unrestricted state is established at the engaging member 65 (FIG. 2A) in the laser beam printer 1.

When the process cartridge 19 is attached to the body casing 2 as described above, in conjunction with the attachment of the process cartridge 19 to the body casing 2, the engaging member 65 moves from the restricting position to the unrestricting position, so that the restriction on the detachment of the developing cartridge 20 from the frame 50 is removed at the engaging member 65. Therefore, it is unnecessary to change the position of the engaging members 65 when the developing cartridge 20 is detached from the body casing 2, so that the operability can be improved when the developing cartridge 20 is removed from the body casing 2.

To remove the process cartridge 19 from the body casing 2, the drum handle 56 is operated from the front to move the process cartridge 19 forward along the mounting path 47. Then, the engagement operating portion 70 contacts the pillar member 79 after the disengagement operating portion 69 passes above the pillar member 79, and the lower end portion of the engagement operating portion 70 is pushed upward by the pillar member 79 in accordance with the movement of the process cartridge 19. Thus, the engaging member 65 rotates about the support shaft 64 to engage the engaging portion 68 of the engaging member 65 with the engagement boss 66, so that the restricted state is established at the engaging member 65 (FIG. 2B).

When the process cartridge 19 is removed from the body casing 2 as described above, in conjunction with the detachment of the process cartridge 19 from the body casing 2, the position of the engaging member 65 returns to the restricting position from the unrestricting position, so that the detachment of the developing cartridge 20 from the frame 50 is restricted at the engaging members 65. Therefore, it is unnecessary to change the position of the engaging members 65 when the developing cartridge 20 is detached from the body casing 2, for example, in order to clear a paper jam, so that the operability can be improved when the process cartridge 19 is removed from the body casing 2. In addition, in the state where the process cartridge 19 is separated from the body casing 2, the developing cartridge 20 can be prevented from being easily detached from the frame 50. As a result, the exposure of the photosensitive drum 21 caused by the detachment of the developing cartridge 20 from the frame 50 can be prevented, so that damage to the photosensitive drum 21 can be prevented in the state where the process cartridge 19 is separated from the body casing 2.

To remove the developing cartridge 20 from the process cartridge 19 while leaving the process cartridge 19 in the body casing 2, as shown in FIG. 3, the developing cartridge handle 63 is operated from the front to move the developing cartridge 20 forward after the hook portion 74 of the manual engaging member 72 is disengaged from the projecting portion 78 to release the restricted state at the manual engaging member 72. As should be appreciated, when the developing cartridge 20 is removed from the process cartridge 19, the engaging member 65 is in the unrestricting position. To attach the developing cartridge 20 to the process cartridge 19 while the process cartridge 19 is attached to the body casing 2, the developing cartridge handle 63 is operated from the front to move the developing cartridge 20 rearward. Then, the hook portion 74 of the manual engaging member 72 is engaged with the projecting portion 78 to establish the restricted state at the manual engaging member 72. In the state where the process cartridge 19 is separated from the body casing 2, the developing cartridge 20 can be attached to and detached from the process cartridge 19 in a similar fashion to the above.

In the above-described process cartridge 19, the detachment of the developing cartridge 20 from the frame 50 can be restricted by the engagement of the hook portion 74 of the manual engaging member 72 with the projecting portion 78. Thus, the detachment of the developing cartridge 20 from the frame 50 can be further restricted in the state where the process cartridge 19 is separated from the body casing 2. As a result, the exposure of the photosensitive drum 21 and damage to the photosensitive drum 21 can be further prevented.

The hook portion 74 can be engaged with and disengaged from the projecting portion 78 by the simple manual operation that the manual engaging member 72 is rotated. Accordingly, in the state where the process cartridge 19 is detached from the body casing 2, the developing cartridge 20 can be restricted from being detached from the frame 50 without loss of the operability during the detachment of the developing cartridge 20 from the body casing 2.

In the laser beam printer 1, because the transfer roller 34 is provided to the body casing 2, the portion of the photosensitive drum 21 facing the transfer roller 34 is exposed when the process cartridge 19 is detached from the body casing 2. Therefore, when the developing cartridge 20 is separated from the frame 50 in the state where the process cartridge 19 is detached from the body casing 2, the portion of the photosensitive drum 21 facing the developing cartridge 20 is further exposed and the exposed portion of the photosensitive drum 21 is expanded. When the detachment of the developing cartridge 20 is restricted by the engagement of the engaging members 65 with the engagement bosses 66 and the engagement of the manual engaging member 72 with the projecting portion 78 in the state where the process cartridge 20 is detached from the body casing 2, the expansion of the exposed portion of the photosensitive drum 21 can be prevented. Accordingly, a possibility of damage to the exposed portion of the photosensitive drum 21 can be reduced.

Because the drum handle 56 and the developing cartridge handle 63 are separately provided, the drum handle 56 is operated when the process cartridge 19 is attached to and detached from the body casing 2, and the developing cartridge handle 63 is operated when the developing cartridge 20 is attached to and detached from the frame 50. That is, the drum handle 56 and the developing cartridge handle 63 can be used as situation demands. Thus, the operability can be further improved during the attachment and detachment of the process cartridge 19 and the developing cartridge 20.

In addition, because the drum handle 56 and the developing cartridge handle 63 are provided so as to be operated from the front, it is easier to operate the drum handle 56 and the developing cartridge handle 63 through the opening 44 of the body casing 2. Therefore, the operability can be further improved when the process cartridge 19 and the developing cartridge 20 are attached to and detached from the body casing 2.

In this embodiment, instead of having the engagement device on each side, the process cartridge 19 may have the engagement device on only one side. In addition, the process cartridge 19 may have a plurality of manual engagement devices.

Figure 4B:
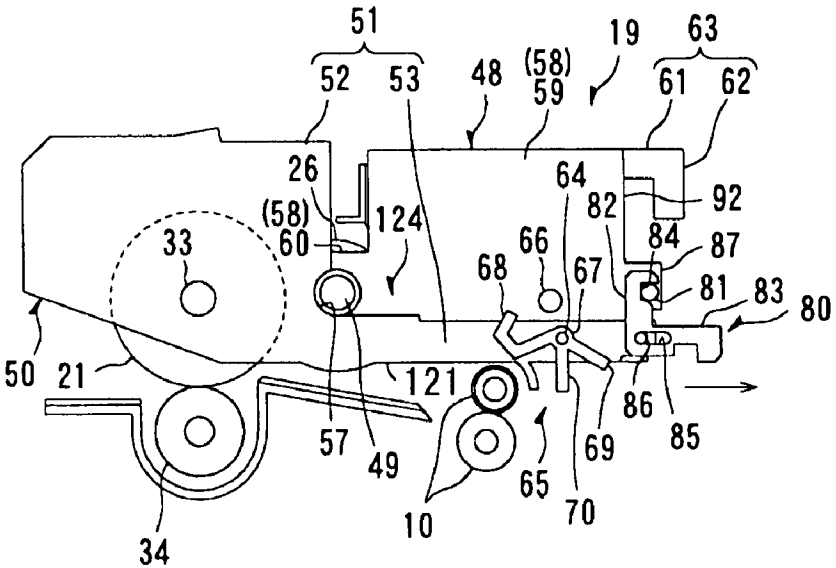
FIG. 4B is a side view of the process cartridge of FIG. 4A, wherein the manual engaging member is in a restricting state.
Figure 4A:
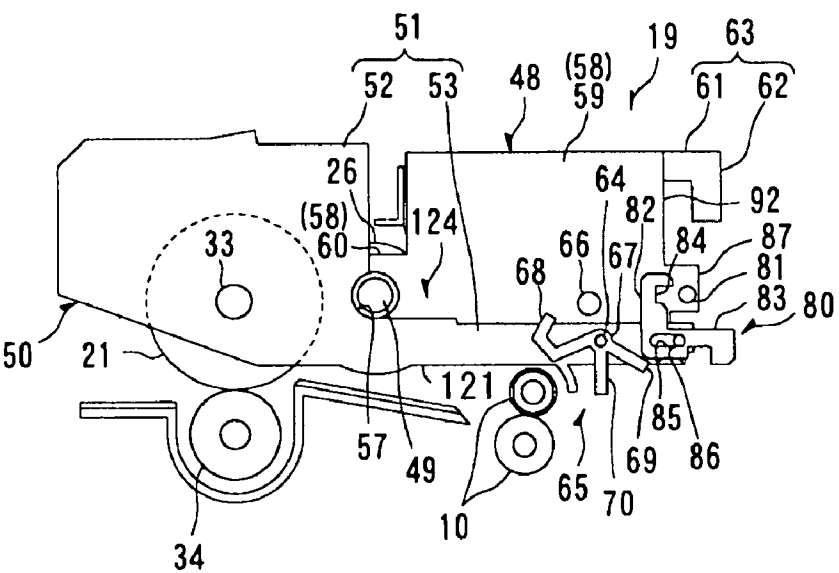
FIG. 4A is a side view of the process cartridge of FIG. 2A of another exemplary embodiment, wherein the process cartridge has a manual engaging member, which is in an unrestricting state.

FIGS. 4A and 4B represent the process cartridge 19 of FIGS. 2A and 2B of another exemplary embodiment. In the description below, the same parts or portions of the process cartridge 19 of FIGS. 4A and 4B as those of the process cartridge 19 of FIGS. 2A and 2B are designated by the same reference numerals, and explanations for the those parts or portions will be omitted.

The process cartridge 19 of FIGS. 4A and 4B includes a slidable engaging member 80 as a third engaging member, and an engagement boss 81 as a third engaged portion, on each side wall 58 of the frame 50. The slidable engaging members 80 and the engagement bosses 81 function as a manual engagement device. Although explanations will be given for one of the slidable engaging members 80 and one of the engagement bosses 81 only, they have the same structure and function on each side.

The slidable engaging member 80 has a substantially L-shape and includes an engaging plate portion 82, which extends in the up and down direction, and an operating plate portion 83, which extends forward from a lower end portion of the engaging plate portion 82 in the process cartridge attaching/detaching direction. The engaging plate portion 82 and the operating plate portion 83 are integrated with each other.

In the slidable engaging member 80, an upper end portion of the engaging plate portion 82 is cut away in a substantially rectangular shape from the front edge toward the rear to provide an engaging recess 84 that can be engaged with the engagement boss 81.

A joint portion of the engaging plate portion 82 and the operating plate portion 83 has a slot 85 extending in the process cartridge attaching/detaching direction. The frame 50 has a shaft 86 outwardly extending in the width direction from the front end portion of the rear side-plate-portion 52. The shaft 86 is inserted into the slot 85 of the slidable engaging member 80. With this structure, the slidable engaging member 80 is attached to the frame 50 so as to be slidable in the process cartridge attaching/detaching direction with respect to the frame 50.

The engagement boss 81 is provided to the housing 48 of the developing cartridge 20. More specifically, each of the side walls 58 of the housing 48 has a projecting portion 87 forwardly projecting from its front edge of the lower end portion. The engagement boss 81 is provided to the projecting portion 87 so as to outwardly extend in the width direction. In addition, the engagement boss 81 is provided to a position where the engaging recess 84 is engaged therewith when the slidable engaging member 80 slides to the foremost position with respect to the shaft 86 in the state where the developing cartridge 20 is attached to the frame 50.

In the state where the process cartridge 19 is attached to the body casing 2, when the operating plate portion 83 is pulled in the process cartridge detaching direction to remove the process cartridge 19 from the body casing 2 the slidable engaging member 80 slides in the detaching direction to engage the engaging recess 84 of the slidable engaging member 80 with the engagement boss 81. Thus, the restricted state where the detachment of the developing cartridge 20 from the frame 50 is restricted is established. Therefore, the developing cartridge 20 can be detached from the body casing 2 together with the process cartridge 19.

When the operating plate portion 83 is pressed in the process cartridge attaching direction to attach the process cartridge 19 to body casing 2, the slidable engaging member 80 slides in the attaching direction and thus the engaging recess 84 of the slidable engaging member 80 is disengaged from the engagement boss 81. Thus, the unrestricted state where the detachment of the developing cartridge 20 from the frame 50 is allowed is established. Therefore, the developing cartridge 20 can be separated from the developing cartridge 19 and pulled out of the body casing 2. In the process cartridge 19 of FIGS. 4A and 4B, in conjunction with the attachment and detachment of the process cartridge 19 with respect to the body casing 2, the developing cartridge 19 is changed between the restricted state and the unrestricted state with respect to the frame 50. Accordingly, the operability can be further improved during the attachment and detachment of the process cartridge 19 with respect to the body casing 2.

In this embodiment, instead of having the manual engagement device on each side, the process cartridge 19 may have the manual engagement device on only one side.

Figure 5B:
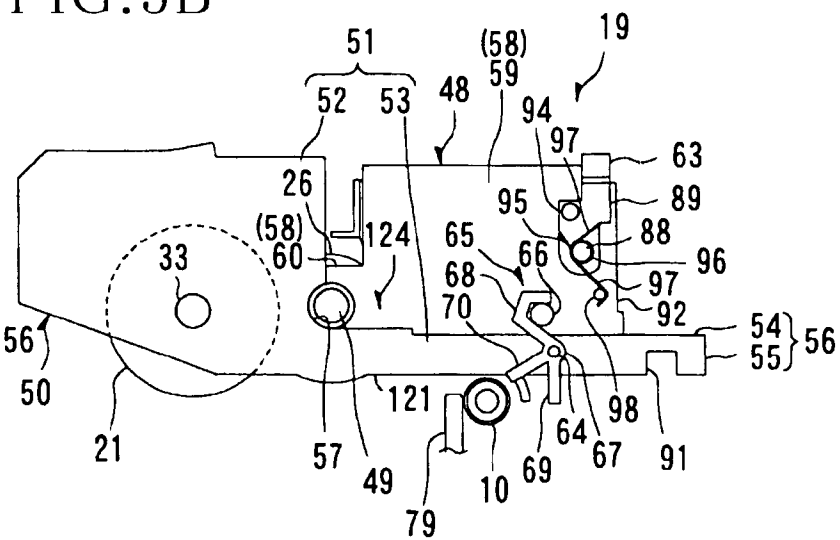
FIG. 5B is a side view of the process cartridge of FIG. 5A, wherein the developing-cartridge-side handle is located at a restricting position.
Figure 5A:
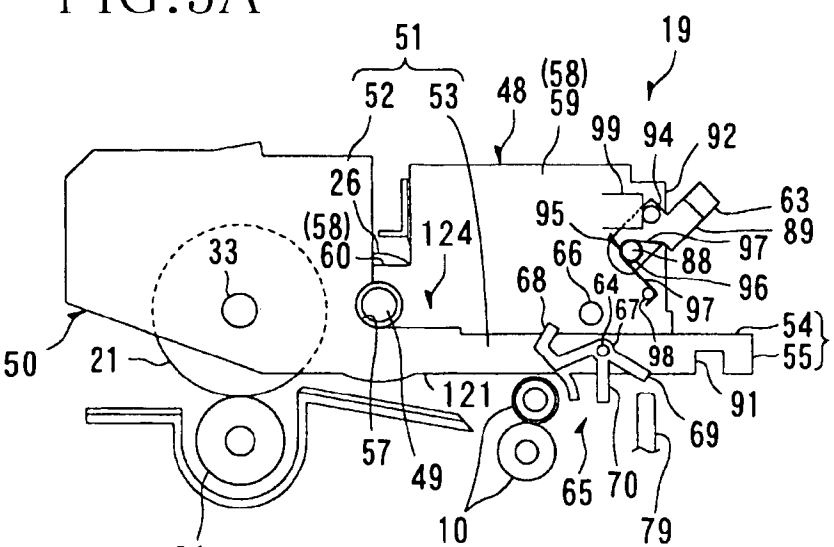
FIG. 5A is a side view of the process cartridge of FIG. 2A of another exemplary embodiment, wherein the process cartridge has a movable developing-cartridge-side handle, which is located at an unrestricting position.

FIGS. 5A and 5B represent the process cartridge 19 of FIGS. 2A and 2B of another exemplary embodiment. In the description below, the same parts or portions of the process cartridge 19 of FIGS. 5A and 5B as those of the process cartridge 19 of FIGS. 2A and 2B are designated by the same reference numerals, and explanations for the those parts or portions will be omitted.

In this process cartridge 19 of FIGS. 5A and 5B, the developing cartridge handle 63 is provided on each side so as to extend along each side wall 58 of the housing 48 of the developing cartridge 20. The developing cartridge handles 63 are movable between a standby position where the developing cartridge handles 63 are on standby for operation (FIG. 5A) and an operable position where the developing cartridge handles 63 can be operated (FIG. 5B).

More specifically, the process cartridge 19 includes a rotating shaft 88, a rotating member 89, a boss 94 and a torsion spring 95, on each side. Although explanations will be given for one of the rotating shafts 88, the rotating members 89, the bosses 94 and the torsion springs 95 only, they have the same structure and function on each side. The rotating shaft 88 outwardly extends from the front end portion of the side wall 58 of the housing 48 in the width direction. The rotating member 89 has the developing cartridge handle 63 at its one end, and is rotatably supported by the rotating shaft 88 at its other end. The boss 94 outwardly extends in the width direction from a substantially middle position of the rotating member 89. The torsion spring 95 as an urging device urges the rotating member 89 at all times so that the developing cartridge handle 63 is oriented toward the standby position.

The torsion spring 95 has a coil-like wound portion 96 and linear engagement portions 97 extending from both sides of the wound portion 96 in respective directions. The wound portion 96 and the engagement portions 97 are integrated with each other. One of the engagement portions 97 is engaged with a cutaway portion provided to a front of the rotating member 89 and another is fixed by a spring fixing portion 98 provided at a diagonally front lower position with respect to the rotating shaft 88 while the wound portion 96 of the torsion spring 95 is wound around the rotating shaft 88.

In the body casing 2, contact members 99, as a second contact portion, are located in a path over which the bosses 94 move during the attachment of the process cartridge 19.

When the process cartridge 19 is moved in the attaching direction along the mounting path 47, the boss 94 contacts the contact member 99 and the boss 94 is pressed forward by the contact member 99 in accordance with the movement of the process cartridge 19 in the attaching direction after the contact occurs. As a result, the rotating member 89 rotates forward about the rotating shaft 88 against urging force from the torsion spring 95, so that the developing cartridge handle 63 is moved to the operable position at which the developing cartridge handle 63 protrudes forward from the developing cartridge 20 (FIG. 5A). Thus, in the state where the process cartridge 19 is attached to the body casing 2, the developing cartridge handle 63 can be located at the operable position in conjunction with the attaching operation of the process cartridge 19. Accordingly, the developing cartridge handle 63 can be easily operated and the developing cartridge 20 can be easily detached from the body casing 2.

When the process cartridge 19 is detached from the body casing 2, the rotating member 89 rotates rearward about the rotating shaft 88 by the urging force from the torsion spring 95 so that the developing cartridge handle 63 returns to the standby position from the operable position (FIG. 5B). Therefore, it is unnecessary to return the developing cartridge handle 63 to the standby position from the operable position when the process cartridge 19 is detached from the body casing 2, so that the operability can be further improved when the process cartridge 19 is detached from the body casing 2.

In this embodiment, instead of having the developing cartridge handle 63 on each side, the process cartridge 19 may have the developing cartridge handle 63 on only one side.

Figure 6:
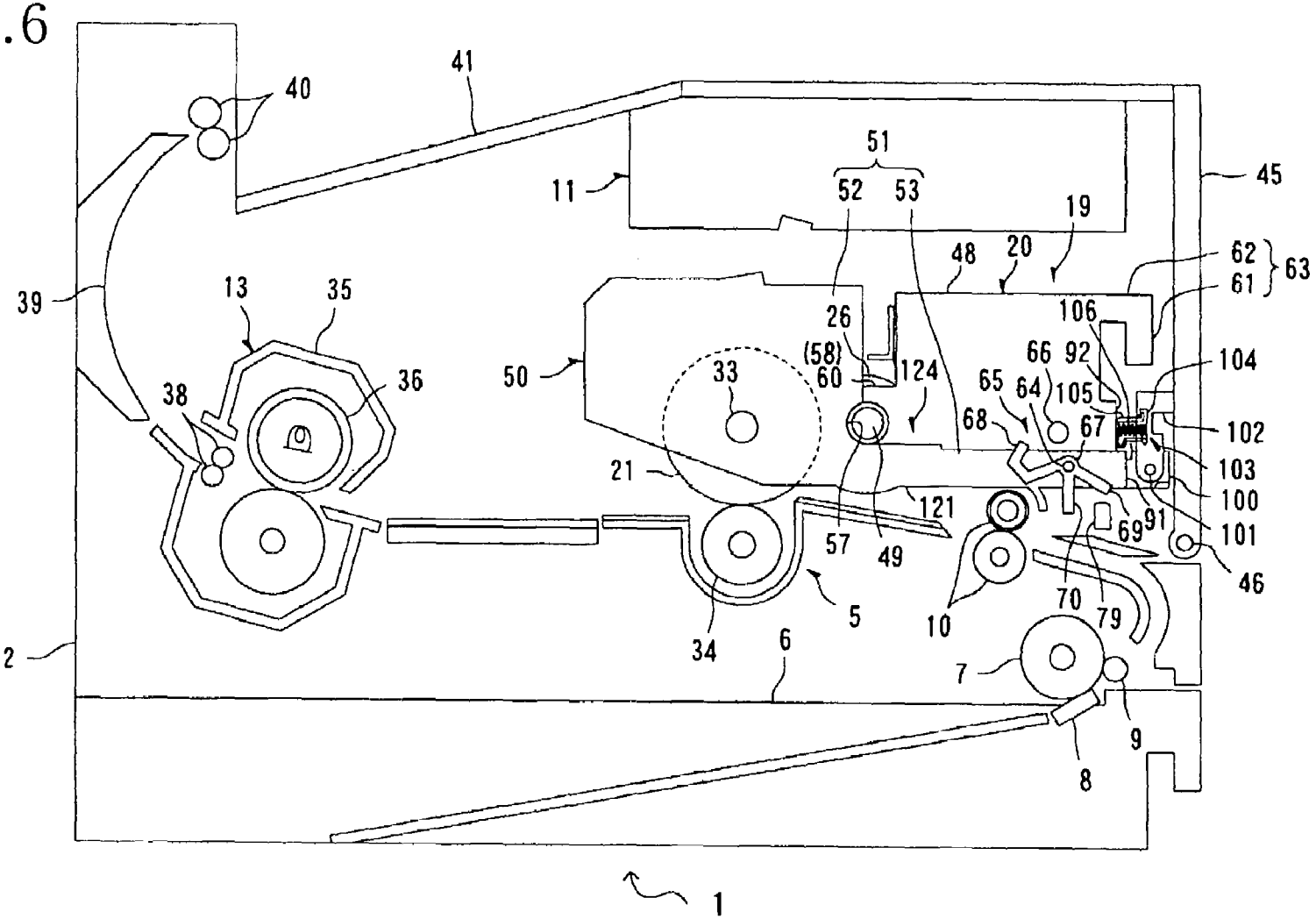
FIG. 6 is a side sectional view showing essential parts of the laser beam printer of FIG. 1 of another exemplary embodiment, wherein pressure is applied to and released from the developing cartridge in conjunction with opening and closing of a front cover.

FIG. 6 illustrates the laser beam printer 1 of FIG. 1 of another exemplary embodiment. In the description below, the same parts or portions of the laser beam printer 1 of FIG. 6 as those of the laser beam printer 1 of FIG. 1 are designated by the same reference numerals, and explanations for the those parts or portions will be omitted.

The process cartridge 19 to be attached to the laser beam printer 1 of FIG. 6 includes a protruding member 100 protruding forward from the front plate 91 of the frame 50. In addition, the process cartridge 19 includes lever rotating shafts 101, which outwardly extends from the side surfaces of the protruding member 100 in the width direction, a pressing lever 102, which is rotatably supported by the lever rotating shaft 101, and a pressing member 103 as an urging device, which is attached to the pressing lever 102. The lever rotating shafts 101, the pressing lever 102 and the pressing member 103 function as a pressure release device.

The pressing lever 102 extends along the side surface of the protruding member 100 and is rotatably supported by the lever rotating shafts 101 at its one end. The other end of the pressing lever 102 is bent substantially at a right angle toward the front so as to extend substantially along the front wall 92 of the housing 48 of the developing cartridge 20. When the front cover 45 is closed, the front cover 45 contacts the front surface of the other end of the pressing lever 102.

The pressing member 103 includes a fixed portion 104, which is fixed to the pressing lever 102, a pressing portion 105, which is engaged so as to be movable in a direction to become closer to and away from the fixed portion 104, and a compression spring 106, which is interposed between the fixed portion 104 and the pressing portion 105. The pressing member 103 contacts the front wall 92 of the housing 48 of the developing cartridge 20 to press the housing 48 by the urging force from the compressing spring 106, in the state where the pressing lever 102 extends along the front wall 92 of the housing 48 of the developing cartridge 20.

In the state where the front cover 45 is closed, the front cover 45 contacts the other end of the pressing lever 102, so that the pressing portion 105 of the pressing member 103 contacts the housing 48 of the developing cartridge 20 to press the housing 48 of the developing cartridge 20 toward the photosensitive drum 21 by the urging force from the compression spring 106 of the pressing member 103. Thus, the photosensitive drum 21 can hold a toner image by which toner is surely supplied to the surface of the photosensitive drum 21.

Figure 7:
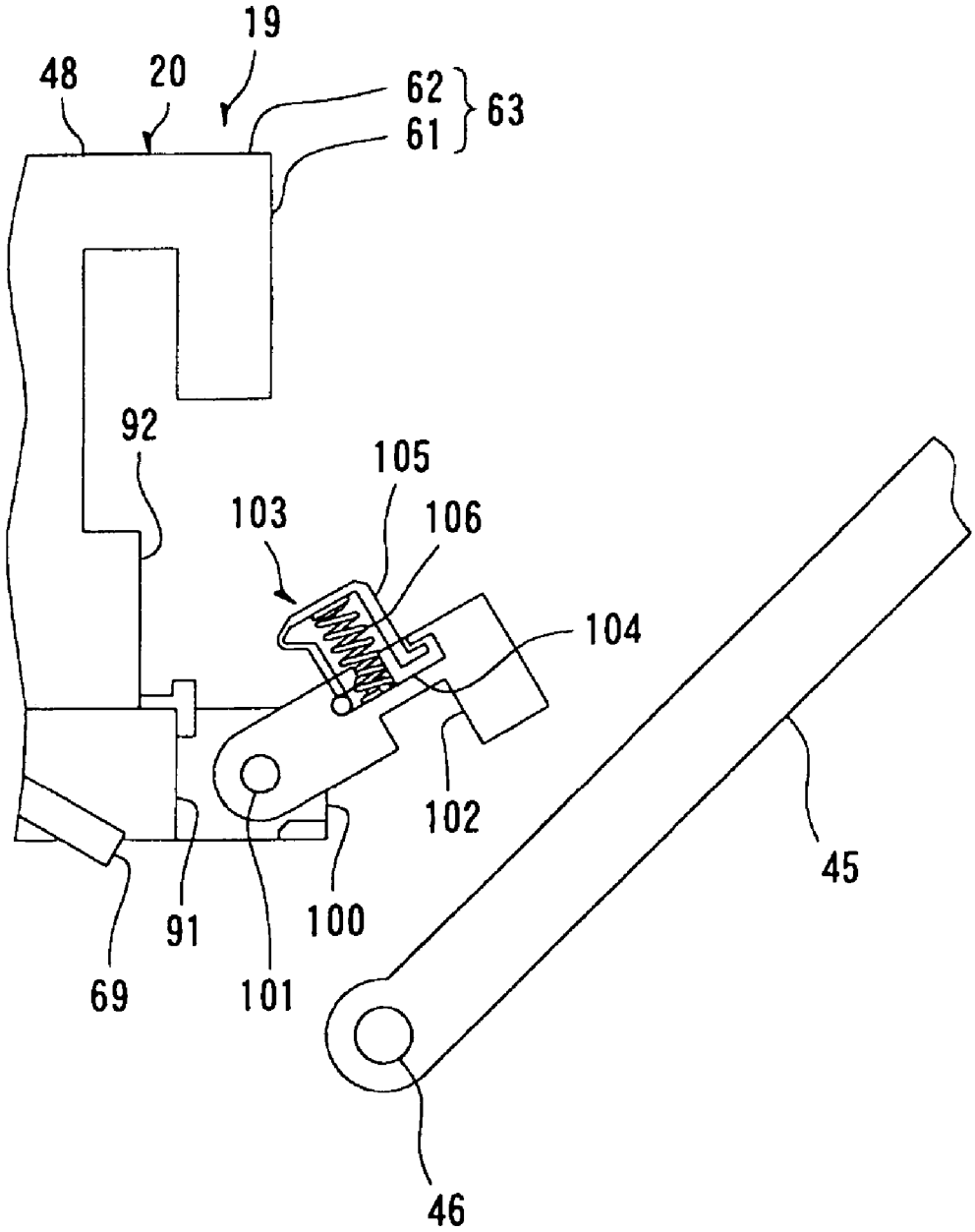
FIG. 7 is a partially enlarged side view of FIG. 6, wherein the pressure on the developing cartridge is released by opening the front cover.

As shown in FIG. 7, when the front cover 45 is open, the front cover 45 is separated from the pressing lever 102, so that the pressing lever 102 rotates forward about the lever rotating shafts 101 by the urging force from the compression spring 106 so that the pressing member 103 moves away from the housing 48 of the developing cartridge 20. As a result, the pressure on the housing 48 applied by the pressing member 103 is removed, so that the developing cartridge 20 can be unforcedly detached from the frame 50.

With this structure, in conjunction with the opening and closing of the front cover 45, the pressure can be applied to and removed from the developing cartridge 20 by the pressing member 103. Particularly, the pressure on the housing 48 applied by the pressing member 103 is removed in conjunction with the opening of the front cover 45, so that the operability can be further improved when the developing cartridge 20 is detached from the frame 50.

In this embodiment, instead of the single pressure release device, the process cartridge 19 may have a plurality of pressure release devices.

Figure 8:
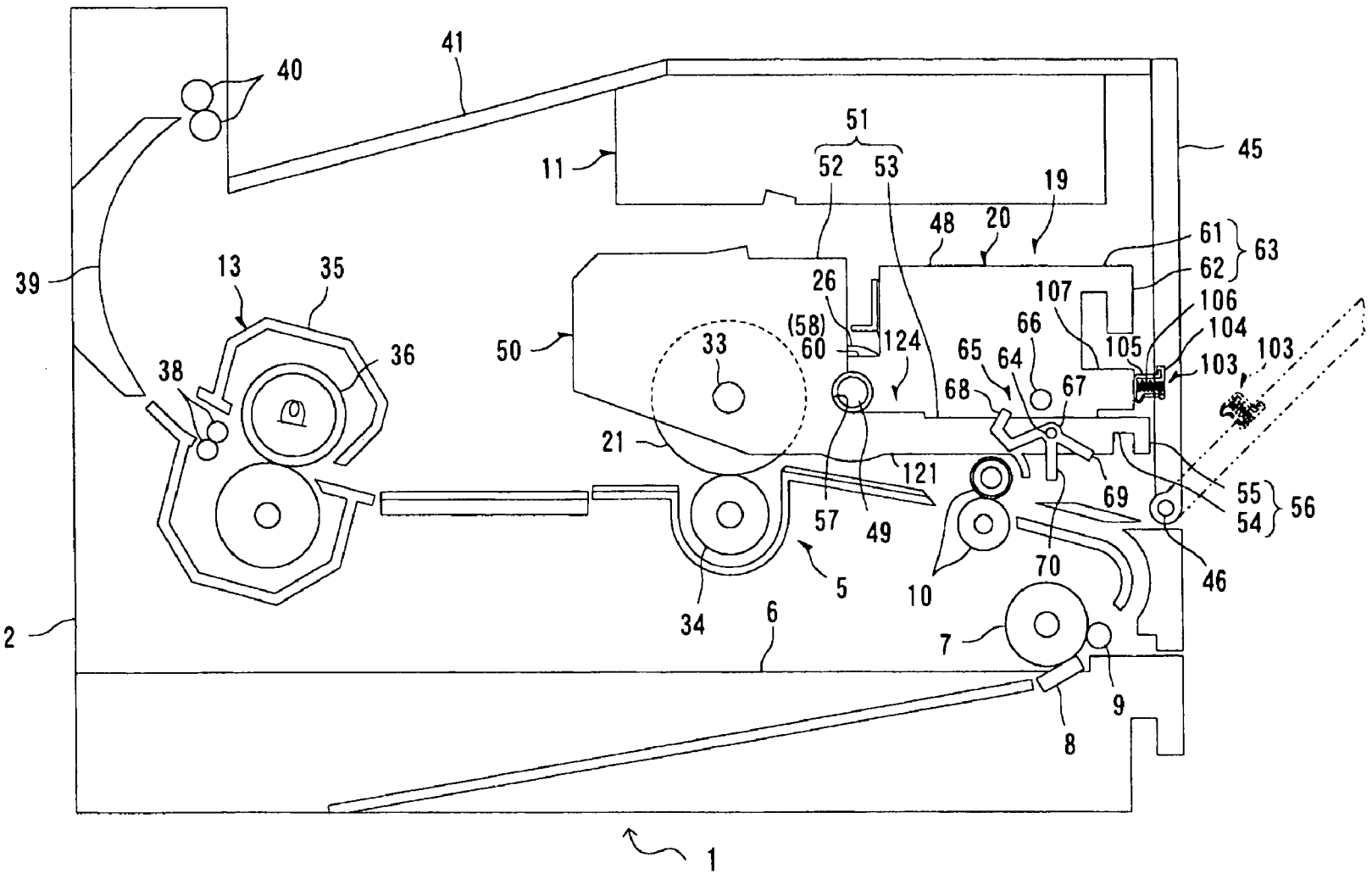
FIG. 8 is a side view of the laser beam printer of FIG. 1 of another exemplary embodiment, wherein the front cover has a pressing member.

FIG. 8 illustrates the laser beam printer 1 of FIG. 1 of another exemplary embodiment. In the description below, the same parts or portions of the laser beam printer 1 of FIG. 8 as those of the laser beam printer 1 of FIG. 1 are designated by the same reference numerals, and explanations for the those parts or portions will be omitted.

In the laser printer 1 of FIG. 8, the front cover 45 is provided with the pressing member 103 (having the same structure as that provided to the process cartridge 19 of FIG. 6). When the front cover 45 is closed, the pressing member 103 contacts the protruding portions 107, which protrude forward from the front wall 92 of the housing 48 of the developing cartridge 20, to press the developing cartridge 20 toward the photosensitive drum 21. When the front cover 45 is open, the pressing member 103 is separated from the protruding portions 107 to remove the pressure on the housing 48 applied by the pressing member 103.

With this structure, the effect that is the same as that obtained by the structure of FIG. 6 can be obtained. That is, in conjunction with the opening and closing of the front cover 45, the pressure can be applied to and removed from the developing cartridge 20 by the pressing member 103. Particularly, the pressure on the housing 48 applied by the pressing member 103 is released in conjunction with the opening of the front cover 45, so that the developing cartridge 20 can be unforcedly detached from the frame 50. In addition, the operability can be further improved during the detachment of the developing cartridge 20 from the frame 50.

In this embodiment, instead of having the single pressing member 103, the front cover 45 may have a plurality of pressing members 103.

Figure 9B:
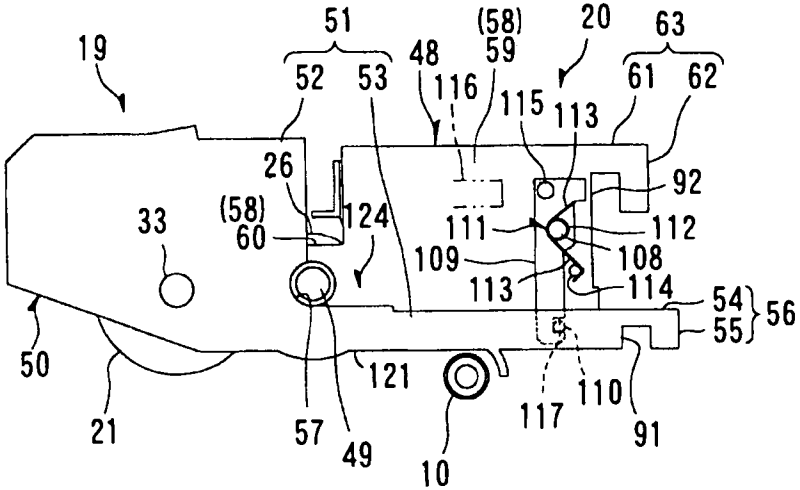
FIG. 9B is a side view of the process cartridge of FIG. 9A, wherein the engaging member is located at a restricting position.
Figure 9A:
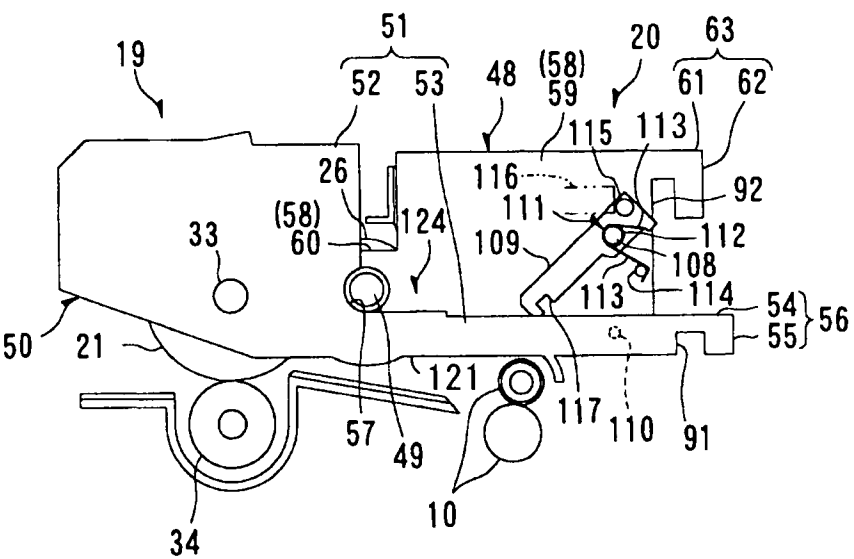
FIG. 9A is a side view of the process cartridge of FIG. 2A of another exemplary embodiment, wherein the developing cartridge has an engaging member, which is located at an unrestricting position.

FIGS. 9A and 9B represents the process cartridge 19 of FIGS. 2A and 2B of another exemplary embodiment. In the description below, the same parts or portions of the process cartridge 19 of FIGS. 9A and 9B as those of the process cartridge 19 of FIGS. 2A and 2B are designated by the same reference numerals, and explanations for the those parts or portions will be omitted.

The process cartridge of FIGS. 9A and 9B includes a support shaft 108, an engaging member 109, and an engagement boss 110 as an engaged portion, on each side. The support shafts 108, the engaging members 109 and the engagement bosses 110 function as an engagement device. Although explanations will be given for one of the support shafts 108, the engaging members 109 and the engagement bosses 110 only, they have the same structure and function on each side.

The support shaft 108 outwardly extends in the width direction from the forward part of the side wall 58 of the housing 48 of the developing cartridge 20.

The engaging member 109 has a substantially rectangular shape and is rotatably supported by the support shaft 108 at a position slightly above a middle position of the engaging member 109. A lower end portion of the engaging member 109 is cut away in a substantially rectangular shape from a front edge toward the rear to provide an engagement recess 117 engageable to the engagement boss 110. The engaging member 109 has a boss 115 extending in the width direction, at its upper end. The engaging member 109 is supported by the support shaft 108 so as to be able to rotate about the support shaft 108 between a position where the engaging member 109 extends in the up and down direction and an inclined position where the engaging recess 117 and the boss 115 are located at the rear side and the front side, respectively. The engaging member 109 is urged at all times by a torsion spring 111 so that the engaging recess 117 and the boss 115 are oriented toward the front and the rear, respectively.

That is, the torsion spring 111 has a coil-like wound portion 112 and linear engagement portions 113 extending from both sides of the wound portion 112 in respective directions. The wound portion 112 and the engagement portions 113 are integrated with each other. One of the engagement portions 113 is engaged with a step portion provided to a forward portion of the engaging member 109 and another is fixed at the side wall 58 of the housing 48 by a spring fixing portion 114 provided at a diagonally front lower position with respect to the support shaft 108 while the wound portion 112 of the torsion spring 111 is wound around the support shaft 108.

The engagement boss 110 inwardly extends from the front side-plate portion 53 of the frame 50 in the width direction. As shown in FIG. 9B, the engagement boss 110 is provided at a position where the engaging member 109 engages the engagement boss 110 when the engaging member 109 extends in the up and down direction in the state where the developing cartridge 20 is attached to the frame 50. When the engaging recess 117 is engaged with the engagement boss 110, the restricted state where the detachment of the developing cartridge 20 from the frame 50 is restricted is established. When the engaging recess 117 is disengaged from the engagement boss 110, the unrestricted state where the detachment of the developing cartridge 20 from the frame 50 is unrestricted is established.

In the body casing 2, contact members 116, as a third contact portion, are provided in a path over which the bosses 115 move during the attachment of the process cartridge 19.

When the process cartridge 19 is moved in the attaching direction, the boss 115 contacts the contact member 116 and the boss 115 is pressed forward by the contact member 116 in accordance with the movement of the process cartridge 19 in the attaching direction after the contact occurs. Then, the engaging member 109 rotates about the support shaft 108 against the urging force from the torsion spring 111. The engaging recess 117 of the engaging member 109 is disengaged from the engagement boss 110, so that the restriction on the detachment of the developing cartridge 20 from the frame 50 is released (FIG. 9A). Therefore, it is unnecessary to change the position of the engaging members 109 when the developing cartridge 20 is detached from the body casing 2 in the state where the process cartridge 19 is attached to the body casing 2, so that the operability can be improved when the developing cartridge 20 is removed from the body casing 2.

When the process cartridge 19 is detached from the body casing 2, the engaging member 109 rotates about the support shaft 108 by the urging force from the torsion spring 111, so that the engaging recess 117 is engaged with the engagement boss 110. Thus, the detachment of the developing cartridge 20 of the frame 50 is restricted (FIG. 9B). Therefore, it is unnecessary to change the position of the engaging member 109 when the developing cartridge 20 is detached from the body casing 2, so that the operability can be improved when the developing cartridge 20 is detached from the body casing 2. In addition, in the state where the process cartridge 19 is separated from the body casing 2, the developing cartridge 20 can be prevented from being easily detached from the frame 50. As a result, the exposure of the photosensitive drum 21 caused by the detachment of the developing cartridge 20 from the frame 50 can be prevented, so that damage to the photosensitive drum 21 can be prevented in the state where the process cartridge 19 is separated from the body casing 2.

In this embodiment, although having the engagement device is on each side, the process cartridge 19 may have the engagement device on only one side.

Figure 10A:
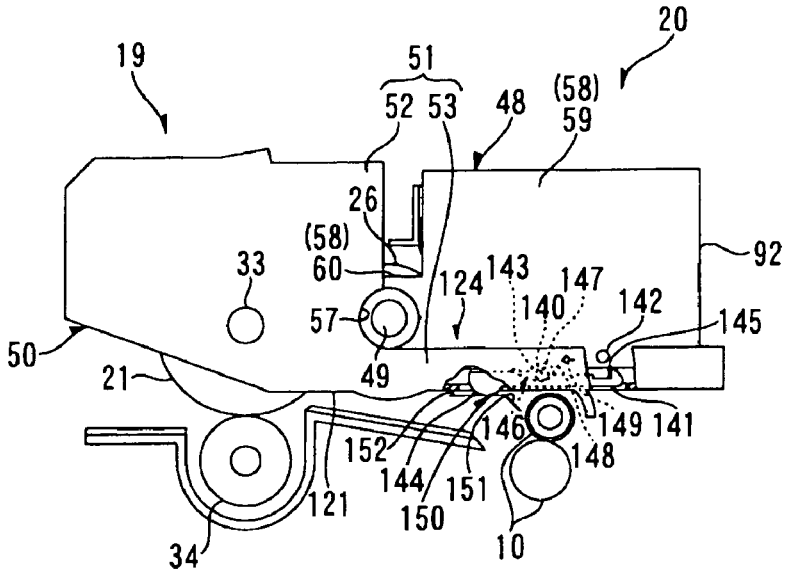
FIG. 10A is a side view of the process cartridge of FIG. 2A of another exemplary embodiment, wherein an engaging member is interposed between the developing cartridge and the frame and the engaging member is located at an unrestricting position.
Figure 10B:
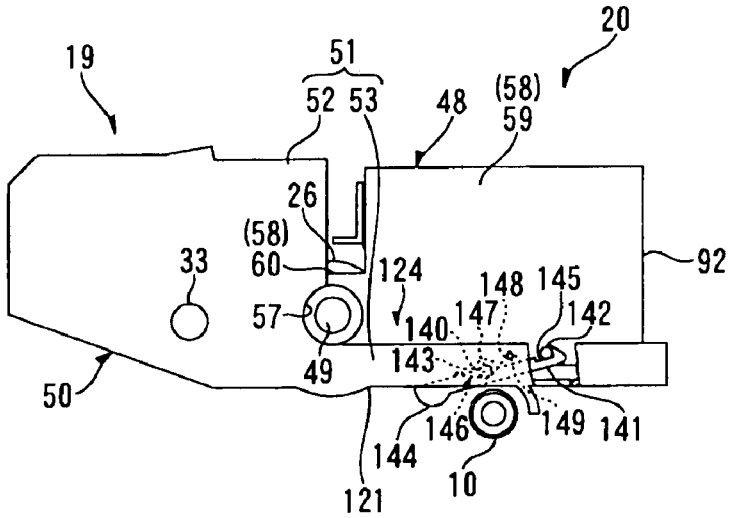
FIG. 10B is a side view of the process cartridge of FIG. 10A, wherein the engaging member is located at a restricting position.

FIGS. 10A and 10B represent the process cartridge 19 of FIGS. 2A and 2B of another exemplary embodiment. In the description below, the same parts or portions of the process cartridge 19 of FIGS. 10A and 10B as those of the process cartridge 19 of FIGS. 2A and 2B are designated by the same reference numerals, and explanations for the those parts or portions will be omitted.

Figure 10C:
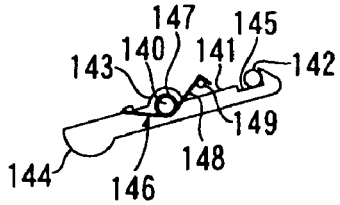
FIG. 10C is an enlarged view of an engagement device, including the engaging member of FIG. 10A, of the process cartridge of FIG. 10A.

The process cartridge 19 of FIGS. 10A and 10B includes a support shaft 140, an engaging member 141, and an engagement boss 142 as an engagement portion, on each side. The support shafts 140, the engaging members 141 and the engagement bosses 142 function as an engagement device (FIG. 10C). Although explanations will be given for one of the support shafts 140, the engaging members 141 and the engagement bosses 142 only, they have the same structure on each side.

The support shaft 140 is provided to the front side-plate-portion 53 of the side plate 51 of the frame 50. More specifically, the support shaft 140 inwardly protrudes in the width direction from the middle portion of the front side-plate-portion 53 in the front and rear direction.

The engaging member 141 has a plate-shape extending in parallel with the front side-plate-portion 53 and is rotatably supported by the support shaft 140 at the inner surface of the front side-plate-portion 53. The engaging member 141 includes a shaft insertion portion 143, into which the support shaft 140 is inserted, a guided portion 144 as a release member, which downwardly protrudes from a lower edge of a rear end portion of the engaging member 141 and has a substantially semi-circular shape, and an engaging portion 145, which has a substantially C-shaped portion upwardly opened at a front end portion of the engaging member 141. The shaft insertion portion 143 upwardly protrudes from an upper edge of the engaging member 141 at a substantially central portion in its longitudinal direction and has a substantially semi-circular shape. The shaft insertion portion 143, the guided portion 144 and the engaging portion 145 are integrated with each other. The engaging member 141 is disposed so as to be swingable about the support shaft 140 between a position where the engaging member 141 extends in the longitudinal direction of the front side-plate-portion 53 and the guided portion 144 stays within the frame 50 (FIG. 10A) and a position where the engaging member 141 inclinatory extends with respect to the longitudinal direction of the front side-plate-portion 53 and the guided portion 144 protrudes from the lower edge of the front side-plate-portion 53 (FIG. 10B). The engaging member 141 is urged at all times by a torsion spring 146 in a direction so that the guided portion 144 protrudes from the lower edge of the frame 50.

In the engaging member 141, the torsion spring 146 has a coil-like wound portion 147 and linear engagement portions 148 extending from both sides of the wound portion 147 in respective directions. The wound portion 147 and the engagement portions 148 are integrated with each other. One of the engagement portions 147 is engaged with a step portion provided behind the shaft insertion portion 143 and another is fixed at the inner surface of the front side-plate-portion 53 of the frame 50 by a spring fixing portion 149 provided at a diagonally front upper position with respect to the support shaft 140 while the wound portion 147 of the torsion spring 146 is wound around the support shaft 140.

The engagement boss 142 outwardly protrudes from the side wall 58 of the housing 48 of the developing cartridge 20 in the width direction. As shown in FIG. 10B, the engagement boss 142 is provided at a position where the engaging member 141 inclinatory extends with respect to the longitudinal direction of the front side-plate-portion 53 of the frame 50 when the developing cartridge 20 is attached to the frame 50 and the engaging portion 145 of the engaging member 141 is engaged with the engagement boss 142 when the guided portion 144 protrudes from the lower edge of the frame 50. When the engaging portion 145 is engaged with the engagement boss 142, the restricted state where the detachment of the developing cartridge 20 from the frame 50 is restricted is established. When the engaging portion 145 is disengaged with the engagement boss 142, the unrestricted state where the detachment of the developing cartridge 20 from the frame 50 is permitted is established.

In the body casing 2, a guiding member 150 as a first contact portion is provided in order to guide the guided portion 144 of the engaging member 141 during the attachment and detachment of the process cartridge 19 with respect to the body casing 2. The guiding member 150 includes an inclined plane 151, which ascends rearward, and a horizontal plane 152, which extends substantially in the horizontal direction from an upper end (a rear end) of the inclined plane 151.

The inclined plane 151 of the guiding member 150 is disposed at a position where the guided portion 144 of the engaging member 141 protruding from the lower edge of the engaging member 141 contacts the included plane 151 when the process cartridge 19 is attached to the body casing 2. When the process cartridge 19 is further moved in the attaching direction after the guided portion 144 of the engaging member 141 contacts the inclined plane 151, the guided portion 144 is moved over the inclined plane 151 toward the horizontal plane 152. In accordance with this movement, the engaging member 141 rotates in a direction to accommodate the guided portion 144 in the frame 50 against the urging force from the torsion spring 146. Thus, the engaging portion 145 of the engaging member 141 is disengaged from the engagement boss 142, so that the restriction on the detachment of the developing cartridge 20 from the casing 50 is removed (FIG. 10A). Therefore, it is unnecessary to change the position of the engaging member 141 when the developing cartridge 20 is detached from the body casing 2, so that operability can be improved when the developing cartridge 20 is detached from the body casing 2.

When the process cartridge 19 is detached from the body casing 2, the guided portion 144 of the engaging member 141 is moved over the horizontal plane 152 of the guiding member 150 toward the inclined plane 151 in accordance with the movement of the process cartridge 19 in the detaching direction. When the process cartridge 19 is further moved in the detaching direction after the guided portion 144 reaches the inclined plane 151, the engaging member 141 rotates in the direction to allow the guided portion 144 to protrude from the lower edge of the frame 50 by the urging force from the torsion spring 111 while the guided portion 144 is guided by the inclined plane 151. Therefore, the engaging portion 145 is engaged with the engagement boss 142, so that the detachment of the developing cartridge 20 from the frame 50 is restricted (FIG. 10B). Accordingly, it is unnecessary to change the position of the engaging member 141 when the process cartridge 19 is detached from the body casing 2, for example, in order to clear a paper jam, so that the operability can be improved when the process cartridge 19 is detached from the body casing 2.

In the state whew the process cartridge 19 is detached from the body casing 2, the engaging member 141 almost stays between the developing cartridge 20 and the frame 50, so that it is difficult to manually operate the engaging member 141. Accordingly, the developing cartridge 20 can be further prevented from being easily detached from the frame 50. As a result, the exposure of the photosensitive drum 21 caused by the detachment of the developing cartridge 20 from the frame 50 can be prevented, so that damage to the photosensitive drum 21 can be prevented in the state where the developing cartridge 20 is detached.

In this embodiment, instead of having the engagement device on each side, the process cartridge 19 may have the engagement device on only one side.

Although, in the above described embodiments, the explanations have been made as to the operation performed at one side only, the same operation is performed at the other side of the process cartridge 19.

According to the above embodiments, when the process cartridge is attached to the image forming apparatus while the detachment of the developing cartridge from the frame is restricted by the engagement device, the engagement device is changed from the restricting state to the unrestricting state by the release device, so that the restriction on the detachment of the developing cartridge from the frame is released. Therefore, it is unnecessary to change the state of the engagement device. Thus, the operability can be improved when the developing cartridge is removed from the image forming apparatus.

When the process cartridge is attached to the image forming apparatus, the release member contacts the first contact member and then the engaging member rotates about the support shaft in a direction to disengage from the engaged portion in accordance with the movement of the process cartridge in the attaching direction. Therefore, in conjunction with the attachment of the process cartridge to the image forming apparatus, the restriction on the detachment of the developing cartridge from the frame imposed by the engagement device can be surely removed.

When the process cartridge is attached to the image forming apparatus, the second release portion contacts the third contact portion and then the engaging member rotates about the support shaft in a direction to disengage from the engaged portion in accordance with the movement of the process cartridge in the attaching direction. Therefore, in conjunction with the attachment of the process cartridge to the image forming apparatus, the restriction on the detachment of the developing cartridge from the frame imposed by the engagement device can be surely removed.

When the process cartridge is detached from the image forming apparatus, the engagement device returns to the restricting state from the unrestricting state, so that the detachment of the developing cartridge from the frame is restricted. Therefore, it is unnecessary to change the state of the engaging device when the process cartridge is detached from the image forming apparatus, for example, in order to clear a paper jam, so that the operability can be improved when the process cartridge is removed from the image forming apparatus. In addition, the developing cartridge can be prevented from being easily detached from the frame in the state where the process cartridge is detached from the image forming apparatus. As a result, the exposure of the image forming apparatus caused by the detachment of the developing cartridge from the frame can be prevented, thereby preventing damage to the image forming apparatus in the state where the process cartridge is detached from the image forming apparatus.

When the process cartridge is detached from the image forming apparatus, the retuning member contacts the first contact portion and then the engaging member rotates about the support shaft in a direction to engage the engaged portion in accordance with the movement of the process cartridge in the detaching direction. Therefore, in conjunction with the detachment of the process cartridge from the image forming apparatus, the restricted state where the detachment of the developing cartridge from the frame is restricted can be surely established.

The process cartridge includes the manual engagement device that can change between the restricting state where the detachment of the developing cartridge from the frame is restricted and the unrestricting state where the detachment of the developing cartridge from the frame is permitted. Therefore, the detachment of the developing cartridge from the frame can be restricted. Thus, the developing cartridge can be further surely prevented from being detached from the frame, so that damage to the image holding body can be further prevented.

By manual operation, the second engaging member is rotated to engage the second engaging member with the second engaged member for restricting the detachment of the developing cartridge from the frame and to disengage the second engaging member from the second engaged member for removing the restriction on the detachment of the developing cartridge from the frame. Accordingly, the detachment of the developing cartridge can be restricted and permitted by the simple manual operation.

When the process cartridge is attached to and detached from the image forming apparatus by operating the frame-side operating portion, the third engaging member slides in the process cartridge attaching/detaching direction, so that the third engaging member is engaged with and disengaged from the third engaged portion. Thus, the manual engagement device can change between the restricting state and the unrestricting state.

The frame-side operating portion and the developing-cartridge-side operating portion are separately provided. That is, the frame-side operating portion and the developing-cartridge-side operating portion can be used as situation demands. That is, the frame-side operating portion is operated when the process cartridge is attached to and detached from the image forming apparatus, and the developing-cartridge-side operating portion is operated when the developing cartridge is attached to and detached from the frame. Thus, the operability can be further improved when the process cartridge and the developing cartridge are attached to and detached from the image forming apparatus.

The frame-side operating portion and the developing-cartridge-side operating portion can be operated from the same side, so that the operability can be further improved when the process cartridge and the developing cartridge are attached to and detached from the image forming apparatus.

In the state where the process cartridge is attached to the image forming apparatus, the developing-cartridge-side operating portion protrudes from the developing cartridge, so that the usability of the developing-cartridge-side operating portion can be increased. Therefore, the operability can be improved when the developing cartridge is removed from the image forming apparatus.

When the process cartridge is attached to the image forming apparatus, the boss of the rotating member contacts the second contact portion and then the rotating member rotates about the support shaft in accordance with the movement of the process cartridge in the attaching direction. Then, the developing-cartridge-side operating portion protrudes from the developing cartridge. Accordingly, in conjunction with the attachment of the process cartridge to the image forming apparatus, the developing-cartridge-side operating portion can be surely positioned at the operable position where the developing-cartridge-side operating portion protrudes from the developing cartridge.

In the state where the process cartridge is detached from the image forming apparatus, the urging member urges the developing-cartridge-side operating portion toward the standby position. Accordingly, when the process cartridge is detached from the image forming apparatus, the developing-cartridge-side operating portion returns to the standby position from the operable position, so that the operability can be further increased.

In the state where the process cartridge is attached to the image forming apparatus, the developing cartridge is urged toward the image holding body by the pressing device. Therefore, the image holding body can hold a developing agent image by which developing agent is surely supplied to the surface of the image holding body. In addition, when the developing cartridge is removed from the frame, the pressure on the developing cartridge applied by the pressing device can be removed by the pressure release device, so that the developing cartridge can be unforcedly removed from the frame.

In conjunction with the opening of the cover member, the pressure on the developing cartridge applied by the pressing device can be removed. Therefore, the operability can be improved when the developing cartridge is removed from the image forming apparatus.

When the cover member is open, the cover member and the pressing lever are out of contact with each other, so that the pressure on the developing cartridge applied by the pressing device is removed. When the cover member is closed, the cover member and the pressing lever are in contact with each other, so that the developing cartridge is pressed by the pressing device. Accordingly, in conjunction with the opening and closing of the cover member, the pressure by the pressing device can be surely applied to and removed from the developing cartridge.

In the state where the process cartridge is detached from the image forming apparatus, the portion, facing the transfer device, of the image holding body is exposed. Therefore, when the developing cartridge is separated from the frame in the state where the process cartridge is detached from the image forming apparatus, the portion, facing the developing cartridge of the image holding device is further exposed and the exposed portion of the image holding body is expanded. When the detachment of the developing cartridge is restricted in the state where the process cartridge is detached from the image forming apparatus, the expansion of the exposed portion of the image holding body can be prevented. Accordingly, a possibility of damage to the exposed portion of the image holding body can be reduced.

While the disclosure has been described in detail with reference to the specific embodiments thereof, it would be apparent to those skilled in the art that various changes, arrangements and modifications may be applied therein without departing from the spirit and scope of the disclosure.

What is claimed is:

1. A process cartridge, comprising:

a developing cartridge;

a frame that detachably mounts the developing cartridge; and an engaging member, provided on the frame, that engages the developing cartridge, wherein:

the engaging member includes an engagement portion and a disengagement portion, the disengagement portion automatically moves the engaging member to a first position when the process cartridge is placed in an image forming device, and the engagement portion automatically moves the engaging member to a second position when the process cartridge is removed from the image forming device.

2. The process cartridge according to claim 1, wherein the developing cartridge, further comprises:

an engagement device that is capable of being engaged with the engaging member associated with the frame, wherein:

in the second postion the engagement device is placed in a restricting state where the engagement device is engaged with the engaging member, in the first position the engagement device is placed in an unrestricting state where the engagement device is disengaged from the engaging member, and the engagement device is automatically placed in the unrestricting state when the developing cartridge is placed in an image forming device.

3. The developing cartridge according to claim 2, further comprising:

a manual engagement device that is capable of being manually engaged with a manual engaging member associated with the frame, wherein:

the manual engagement device can be placed in a second restricting state where the manual engagement device is engaged with the manual engaging member, and the manual engagement device can be placed in a second unrestricting state where the manual engagement device is disengaged from the manual engaging member.

4. The developing cartridge according to claim 2, further comprising:

a pressing device that is capable of pressing the developing cartridge toward an image forming body when the developing cartridge is attached to the image forming device.

5. The developing cartridge according to claim 4, wherein the pressing device is capable of pressing the developing cartridge in conjunction with an opening of a cover member associated with the image forming device.

6. The developing cartridge according to claim 2, further comprising:

a developing-cartridge-side operating portion that is operated when the developing cartridge is attached to and detached from the frame.

7. The developing cartridge according to claim 6, wherein the developing-cartridge-side operating portion is movable between a standby position where the developing-cartridge-side operating portion is on standby for operation and is disposed so as to extend along the developing cartridge, and an operable position where the developing-cartridge-side operating portion is in an operable state and is disposed so as to protrude from the developing cartridge.

8. The developing cartridge according to claim 7, further comprising:

a rotating shaft that is provided to the developing cartridge; and a rotating member that has the developing-cartridge-side operating portion at one end and is rotatably supported by the rotating shaft at another end, the rotating member having a boss between the one end and the another end, wherein the developing-cartridge-side operating portion is located at the standby position when the frame is detached from the image forming device and is located at the operable position by which the boss contacts a first contact portion provided to the image forming apparatus and the rotating member rotates about the rotating shaft because of the pressing of the boss by the first contact portion when a process cartridge is attached to the image forming apparatus.

9. The developing cartridge according to claim 8, further comprising an urging device that urges the rotating member so that the developing-cartridge-side operating portion is oriented toward the standby position in the state where the boss is separated from the first contact portion and the frame is detached from the image forming device.

10. An image forming device, comprising:

the process cartridge according to claim 2.

11. The image forming device according to claim 10, further comprising:

a pressing device that presses the developing cartridge toward an image holding body in the state where the process cartridge is attached to the image forming apparatus.

12. The process cartridge according to claim 1, wherein:

when the engaging member is moved to the first position and a developing cartridge is placed on the frame, the engaging member is placed in an unrestricting state where the engaging member is disengaged from an engagement device of the developing cartridge, and when the engaging member is moved to the second position and a developing cartridge is placed on the frame, the engaging member is placed in a restricting state where the engaging member is engaged with the engagement device of the developing cartridge.

13. The process cartridge according to claim 12, wherein:

the engaging member has a support shaft that is provided to the frame, the engaging member is rotatably supported by the support shaft and is capable of being engaged with and disengaged from the engagement device of the developing cartridge by rotating about the support shaft, and the disengagement portion contacts a first contact portion of the image forming device during attachment of the process cartridge to the image forming device and the first contact portion rotates the engaging member in a direction to disengage the engaging member from the engagement device in accordance with a movement of the process cartridge in an attaching direction.

14. The process cartridge according to claim 12, wherein the engagement portion contacts the first contact portion of the image forming device during detachment of the process cartridge from the image forming device and the first contact portion rotates the engaging member in a direction to engage the engaging member with the engagement device.

15. The process cartridge according to claim 1, further comprising a manual engaging device that can manually change between a second restricting state where the detachment of a developing cartridge from the frame is restricted and a second unrestricting state where the detachment of the developing cartridge from the frame is permitted, by manual operation.

16. The process cartridge according to claim 15, wherein:

the manual engaging device includes a support shaft that is provided to the frame, a second engaging member that is rotatably supported by the support shaft and is capable of being engaged with and disengaged from a second engagement device of the developing cartridge by rotating about the support shaft by manual operation, and the second restricting state is established by the engagement of the second engaging member and the second engagement device and the second unrestricting state is established by the disengagement of the second engaging member and the second engagement device.

17. The process cartridge according to claim 15, wherein:

the manual engaging member includes a second engaging member that is provided to the frame so as to be slidable, the second engaging member is capable of being engaged with and disengaged from a second engagement device of the developing cartridge by sliding relative to the frame, and the second restricting state is established by the engagement of the second engaging member and the second engagement device and the second unrestricting state is established by the disengagement of the second engaging member and the second engagement device.

18. The process cartridge according to claim 1, further comprising:

a frame-side operating portion that is operated when the process cartridge is attached to and detached from the image forming apparatus.

19. The process cartridge according to claim 1, further comprising:

a pressing device that is capable of pressing a developing cartridge attached to the frame toward an image forming body in the state where the process cartridge is attached to the image forming device.

20. The process cartridge according to claim 19, wherein the process cartridge is attached to and detached from the image forming device by opening a cover member provided to the image forming apparatus so as to be able to be open and closed, and a pressure release device releases the pressure on the developing cartridge applied by the pressing device in conjunction with the opening of the cover member.

21. The process cartridge according to claim 20, wherein the pressure release device includes a lever rotating shaft, which is provided to the frame, a pressing lever, which is rotatably supported by the lever rotating shaft and is provided with the pressing device, the pressing lever not contacting the cover member when the cover member is open and contacting the cover member to press the pressing device in a direction to contact the urging device with the developing cartridge when the cover member is closed.

22. An image forming device, comprising:

the process cartridge according to claim 1.

* * * * *